United States Patent [19]

Lafferty, Sr.

[11] Patent Number: 5,003,943

[45] Date of Patent: Apr. 2, 1991

[54] ENGINE AIR INTAKE SHUTOFF APPARATUS

[76] Inventor: Theodore B. Lafferty, Sr., 303 Fabiola Ave., Lafayette, La. 70508

[21] Appl. No.: 358,068

[22] Filed: May 26, 1989

[51] Int. Cl.[5] ..... F02B 77/00

[52] U.S. Cl. ..... 123/198 D; 251/58; 251/203; 251/326

[58] Field of Search ... 123/198 D, 198 DB, DIG. 11; 251/58, 193, 203, 326, 231, 232, 329

[56] References Cited

U.S. PATENT DOCUMENTS

| | | | |
|---|---|---|---|
| 2,824,715 | 2/1958 | Williams | 251/329 |
| 3,258,244 | 6/1966 | Hilton | 251/203 |
| 3,610,574 | 10/1971 | Hartman | 251/193 |
| 4,029,289 | 6/1977 | Miffre | 251/58 |
| 4,129,040 | 12/1978 | Hayden, Jr. | 123/198 D |
| 4,422,418 | 12/1983 | Dorn | 123/198 D |
| 4,499,733 | 2/1985 | Farr et al. | 123/198 D |
| 4,537,386 | 8/1985 | Krepela et al. | 251/302 |
| 4,718,637 | 1/1988 | Contin | 251/203 |

FOREIGN PATENT DOCUMENTS

| | | | |
|---|---|---|---|
| 956830 | 9/1982 | U.S.S.R. | 123/198 DB |

*Primary Examiner*—Noah P. Kamen

*Attorney, Agent, or Firm*—Pravel, Gambrell, Hewitt, Kimball & Krieger

[57] ABSTRACT

An engine air intake shutoff apparatus includes a frame that can be attached to and supported by an engine air intake passage such as an engine blower housing over the engine air intake passage. A baffle plate having rollers extending above its surface slidably moves along the side panels of the frame. Rotatable, retractable baffle arms direct the movement of the baffle plate within the housing. The baffle plate has a mitered leading edge that mates with a wedge on the interior of the frame opposite the leading edge of the baffle plate. Baffle arms are secured to rotatable operating shafts at a point above the attachment point of the baffle plate to the baffle arm so that downward force is exerted on the end of the baffle plate. The combination of the mating of the leading edge of the baffle plate and the wedge and the downward and forward force exerted by the baffle arms create an airtight seal between the baffle plate and the frame when the baffle plate is in the closed position. The engine air intake shutoff apparatus may be powered by an actuator assembly which receives a signal from a control system that can be either automatic or remote-manual. The control system may send a signal for shutting off the engine's fuel flow at a point prior to or simultaneous with a signal which causes the pneumatic actuator assembly to move the baffle plate.

16 Claims, 5 Drawing Sheets

ENGINE AIR INTAKE SHUTOFF APPARATUS

BACKGROUND OF THE INVENTION

The present invention relates to an improved device for shutting off the air intake passage of engines. The present invention more particularly relates to an improved apparatus which can safety and efficiently close the air intake passages of diesel engines in emergency situations such as for example when the presence of airborne hydrocarbons threatens controlled engine operation. Even more particularly, the present invention relates to an air intake shutoff apparatus which may be installed over an engine air intake passage such as for example between the engine blower and the engine air filter. The apparatus generally consists of an air passage shutoff assembly, an actuator assembly which can be powered for example pneumatically or hydraulically, and a control assembly which can be activated either automatically or remote-manually. The air passage shutoff assembly has an airtight frame which can be fitted over the air intake passages of an engine, such as may be found on an engine blower. The frame has an air intake passage which has substantially the same size and shape as the air intake passage of the engine. A baffle plate whose movement is guided by rotatable, retractable baffle arms which slide across the air intake passage to close the air passage once a power source such as a pneumatic actuator assembly is activated by a control system which may be either automatic or remote-manual.

Federal regulations now require engine air intake shutoff devices to be installed on all engines where there is a potential for hydrocarbons to be in the atmosphere in which the engine is operating. These regulations will be applicable to mobile offshore drilling units on May 31, 1989.

Some prior art air intake shutoff devices including control systems currently available are priced in excess of $10,000.00 per device, exclusive of installation costs. Mobile offshore drilling units typically have four to ten engines. Some smaller engines may have one blower typically requiring one air intake shutoff device, while larger engines may have two air intake shutoff devices. Thus operators of mobile offshore drilling units are required to make a substantial capital outlay in order to comply with the regulations.

Some prior art air intake shutoff devices such as flapper valves and guillotine type devices are large and have dimensions that exceed the space limitations existing in the hulls of mobile offshore drilling units or vessels.

Some prior art air intake shutoff devices are activated by a gas that will not support combustion, such as for example carbon dioxide. The gas is contained in cylinders until the devices are activated. Once the devices are activated, the gas is injected into the engine intake air stream, displacing the intake air with the inert gas. When engine shutdown is completed, excess gas may escape the engine causing a threat to personnel in the area. In addition, after the gas has been disbursed from the cylinders, the cylinders must be returned to an onshore site to be refilled before the engine can again be operated in compliance with the federal regulations.

Some prior art air intake shutoff devices are not synchronized to allow the engine fuel system to begin shutdown prior to or simultaneously with the activation of the engine air intake shutoff device. When there has been a shutdown of the engine air intake device without coordination with the engine's fuel system shutdown, several problems have arisen. First, the engine air boxes or intake air chambers surrounding the engine's cylinder liners are subject to excessive pressure and possible damage. Second, the air box or hand hole covers on the cylinders have been known to have been blown away from their seats and cause the threat of injury to personnel working in the area.

Some prior art air intake shutoff devices, such as for example, guillotine type or flapper valves which close instantly or almost instantly do not have means for providing a controlled rate of closure of the engine's air intake passage. With instantaneous closure, pneumatic shock occurs to the engine's air intake system resulting in rapid vacuum and air pressure changes. The pneumatic shock may cause the engine's blowers or superchargers and the engine itself to be damaged.

Various prior art devices for shutting down an engine by preventing air from flowing through an engine air intake passage, as well as the apparatus and method of this construction, in general, are known, and found to be exemplary in an undated letter from the Minerals Management Service, United States Department of the Interior to the International Association of Drilling Contractors. The letter notes that there are three types of devices for shutting down a diesel engine. First, there are positive shutoff valves in the engine air intake. Second, there are devices which combine positive shutoff valves in the air intake with either decompression of the engine, or shutting off the fuel supply or modifying the engine to alter its crankcase ventilation air flow. Third, there are devices which will inject a gas that will not support combustion into the engine air intake. Representative companies that have developed these types of devices include the following:

1. Hunt Engine Company of Harvey, La. has a shutoff valve for use on V-8 Electro-Motive Diesel (EMD) engines, known as the "Motokill" system. The system uses a flapper valve to shut off the air flow through the engine air intake passage.

2. Gulf Coast Manufacturing of Houma, La. has a spring-loaded check valve to shut down Deutz diesel engines.

3. Delhomme Industries of New Iberia, La. has a combination air intake shutoff valve and decompression activation kit that can be used on Lister diesel engines. Delhomme also has an air intake shutoff valve that can be used on Onan diesel engines.

4. Amot Controls Corporation has a shutoff valve which uses a rotating butterfly disc valve to close the engine air intake passage.

5. Barber Industries, a division of Bralorne Resources Limited offers a device known as a "Rig Saver Valve" which uses a swing gate to close the engine air intake passage.

6. The Farr Company offers a guillotine valve, known as the "Slammer" which is designed to shut down the engine of diesel-electric locomotives.

GENERAL DISCUSSION OF THE PRESENT INVENTION

The present invention provides an improved engine air intake shutoff apparatus which includes a baffle plate slidably movable over the air intake passage of an engine air intake such as for example an engine blower. The frame supports and guides the baffle plate that is slidably moveable. The frame is of sufficient size to allow the free flow of air through the engine air intake passage when the baffle arms are retracted and the baffle plate is in its open position. A total installation height of the frame of 3.063 inches is optimal in light of the space limitations on mobile offshore drilling units or vessels, but a frame height less than six inches is operable. The exterior of the frame is sealed so that air may enter the engine only through the air intake passage as designed by the engine manufacturer. When the baffle arms and baffle plate are extended, the air intake passage in the interior of the frame remains airtight so no air is allowed into the engine. The baffle arms are affixed to operating shafts which are connected to a power source, such as for example a pneumatic or hydraulic actuator assembly. The engine air intake shutoff apparatus can be connected to a remote control assembly operable either automatically or manually that can transmit a signal to shut off the fuel flow into the engine at a point prior to or simultaneous with a signal for moving the baffle plate.

An object of the present invention is to provide an apparatus for closing the air intake passages of engines at a controlled rate of closure in order to minimize the pneumatic shock that occurs to the engine's air intake system resulting in rapid vacuum and air pressure changes.

Another object of the present invention is to provide an apparatus for closing the air intake passages of engines without the need for tedious, precision alignments of the device and its components.

Another object of the present invention is to provide a device for closing the air intake passages of engines which is coordinated with the engine's existing shutdown systems to allow fuel shutdown to occur prior to or simultaneous with air intake shutdown.

Another object of the present invention is to provide an apparatus for closing the air intake passages of engines which has a total installation height over the air intake passage of less than six (6) inches, so that the device can be installed in the limited space that is available on engines presently in service in the hulls of mobile offshore drilling units and vessels.

Another object of the present invention is to provide an apparatus for closing an engine's air intake passages through the use of a manual control switch at a location remote from the location of the engine.

Another object of the present invention is to provide an apparatus for closing an engine's air intake passages that is relatively inexpensive to build or install.

Another object of the present invention is to provide an apparatus for closing an engine's air intake passages that is non-sparking to allow the engine to be shut down safely in a hydrocarbon-charged atmosphere.

Another object of the present invention is to provide an apparatus for closing an engine's air intake passages that is capable of receiving a signal from either an automatic control system or a remote manual control system.

Another object of the present invention is to provide an apparatus for closing an engine air intake passage that has a power source not susceptible to decay, as other power sources are shut down in an emergency situation such as where the atmosphere is charged with hydrocarbons.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF THE PREFERRED EMBODIMENT

Figure 1:
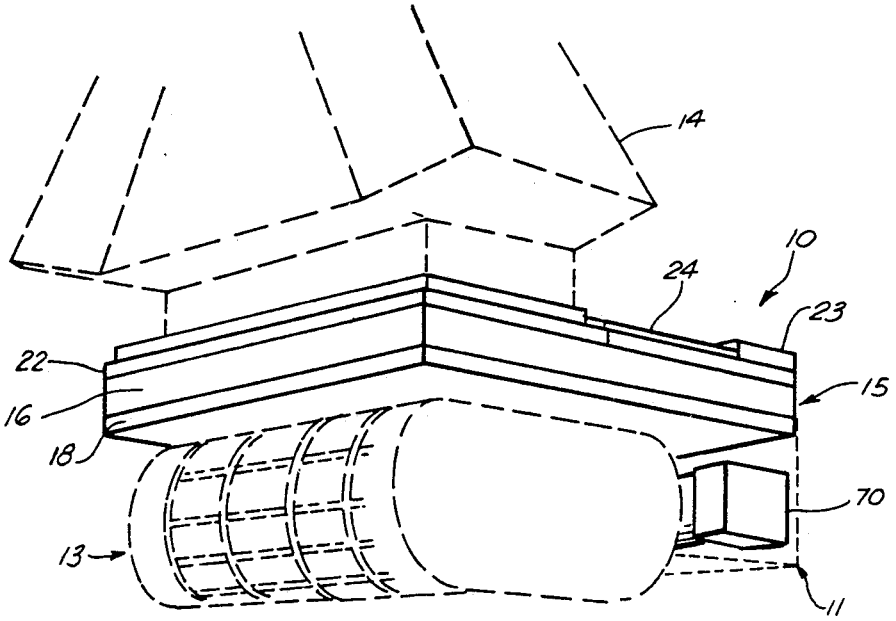
FIG. 1 is a perspective view of the preferred embodiment of the apparatus of the present invention.

The present invention provides an improved engine air intake shutoff apparatus designated generally by the numeral 10 in the drawings. The apparatus includes a guard 11 to prevent injury to personnel, an air passage shutoff assembly 15, pneumatic actuator assembly 70, and a control assembly 100.

Figure 2:
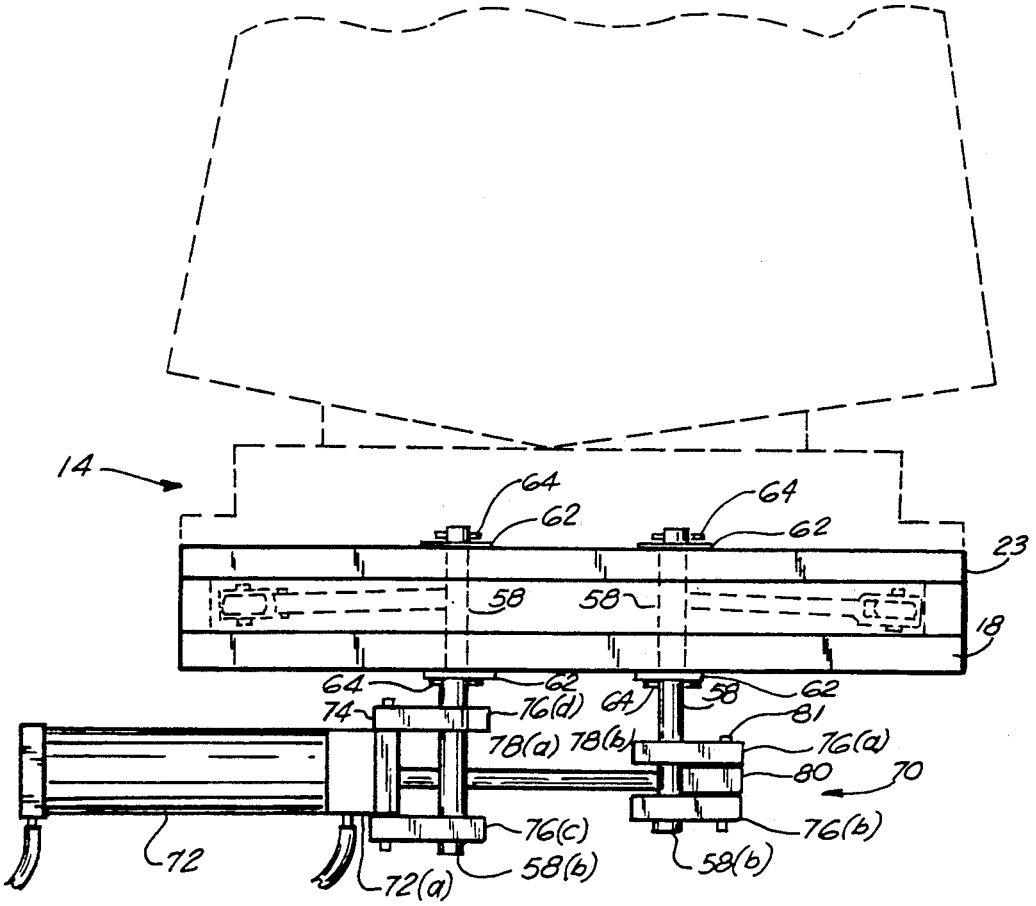
FIG. 2 is an end view of the preferred embodiment of the present invention having the baffle arms in a retracted position.

Air passage shutoff assembly 15 is mounted over air intake passage 12 of engine blower 13. Air passage shutoff assembly 15 can be placed between engine blower 13 and air filter 14. (FIGS. 1 and 2)

Figure 3:
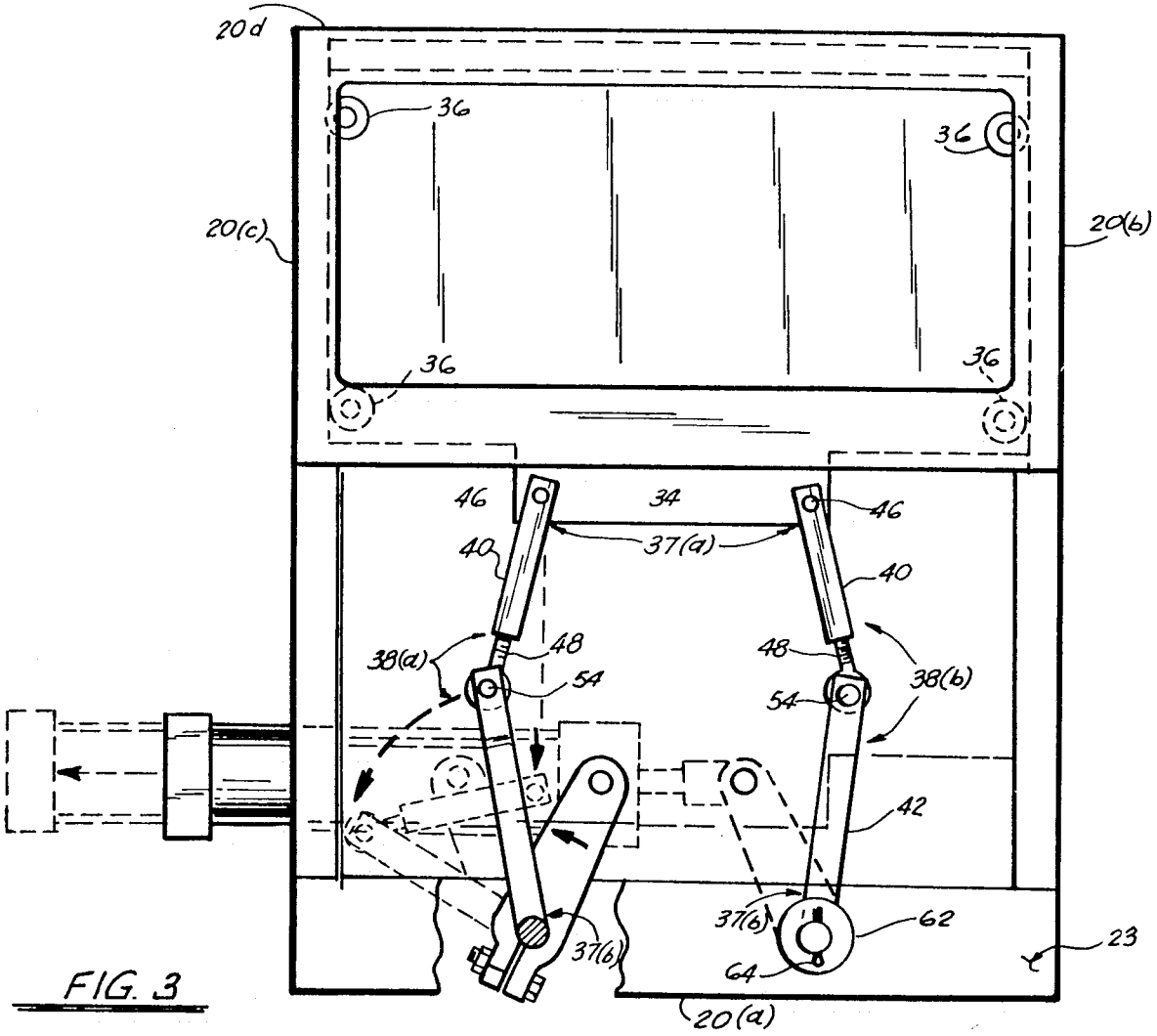
FIG. 3 is a top plan view of the preferred embodiment of the present invention.

Air passage shutoff assembly 15 includes frame 16, baffle plate 30, baffle plate arms 38(*a,b*) and operating shaft 58. (FIGS. 3 and 4)

Figure 5:
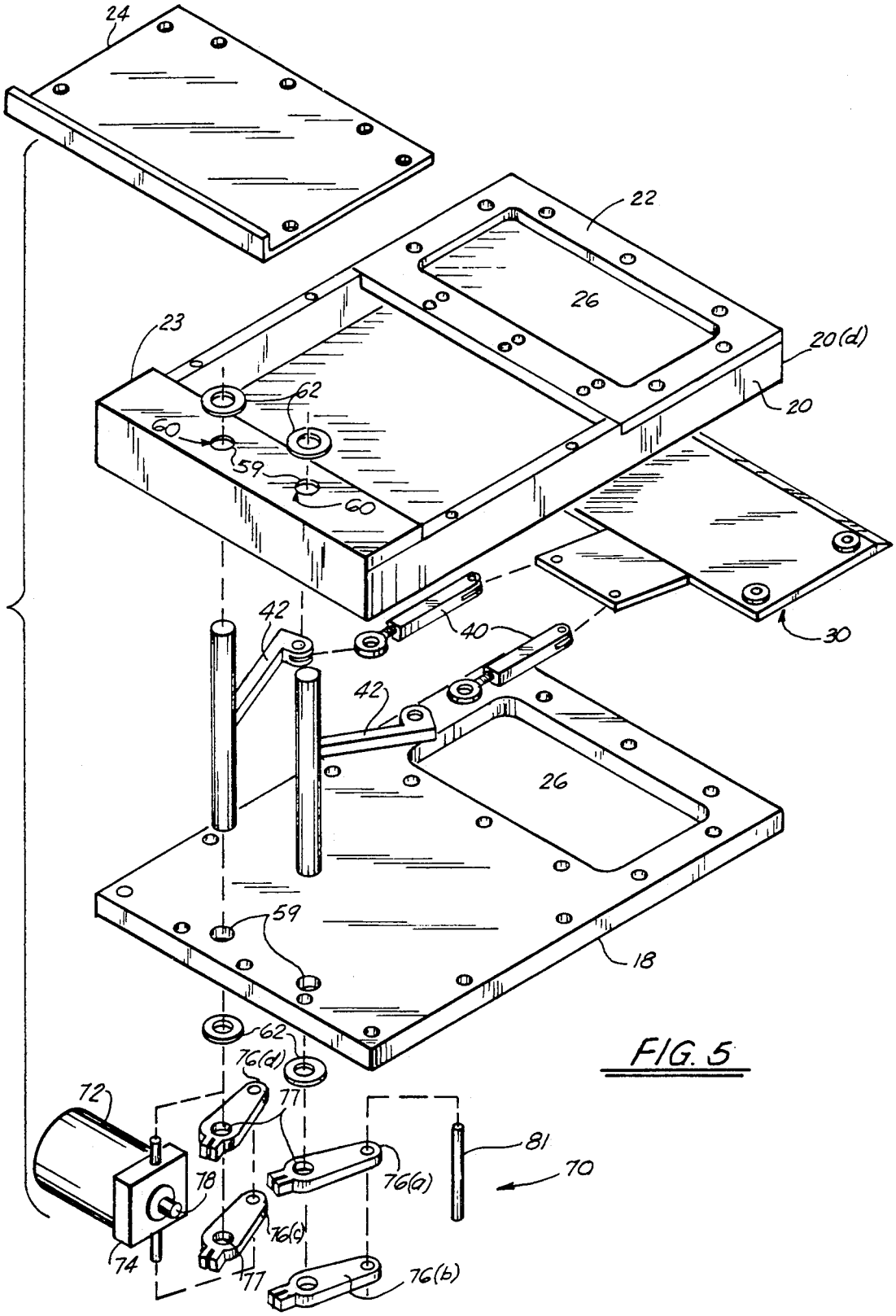
FIG. 5 is an exploded perspective view of the preferred embodiment of the present invention illustrating the construction of the air passage shutoff assembly.

FIG. 5 illustrates frame 16 comprised of bottom plate 18, side panels 20(*a,b,c,d*), air filter foundation plate 22, and cover plate 24.

Bottom plate 18 and air filter foundation plate 22 have air passage 26 whose shape generally conforms to the shape of engine air intake passage 12 to allow the free flow of air to the engine when baffle plate 30 is in an open position. Likewise, baffle plate 30 has a shape that generally conforms to the shape of engine air intake passage 12, but which is of such a size so that air flow to the engine can be shut off when baffle plate 30 is in the closed position.

Figure 4:
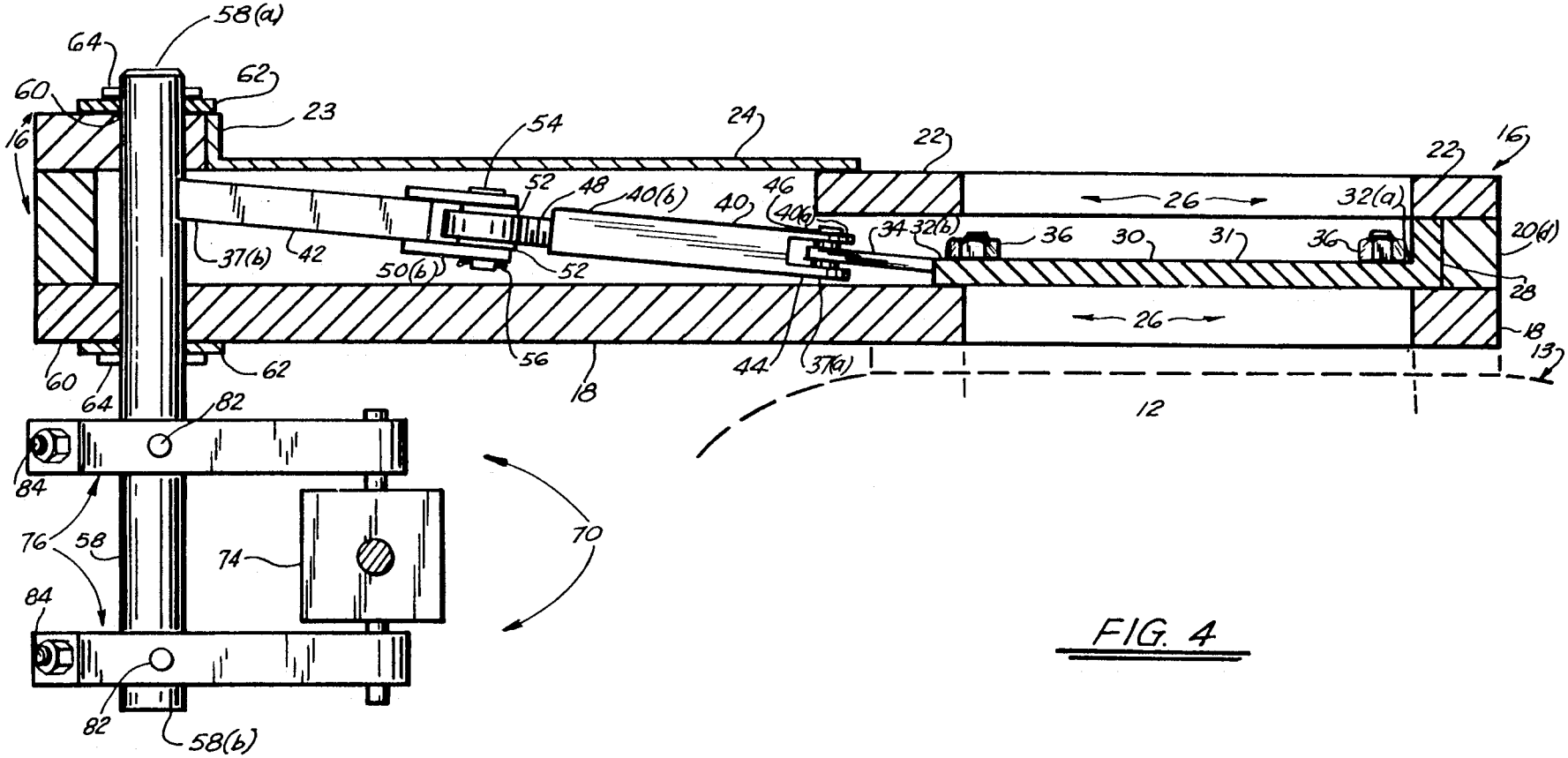
FIG. 4 is a side, cross-sectional view of the preferred embodiment of the present invention.

In FIG. 4, there can be seen the interior of side panel 20*d* which has wedge 28 to receive first end 32(*a*) of baffle plate 30. First end 32(*a*) of baffle plate 30 is mitered to mate with wedge 28 when baffle plate 30 is in a closed position. Baffle plate 30 has second end 32(*b*) which is securely affixed to baffle plate blade 34. Baffle plate 30 has rollers 36 affixed to upper surface 31 of baffle plate 30. Rollers 36 rotatably engage with side panels 20(*b,c*) for accommodating the side edges of baffle plate 30 as baffle plate 30 moves between open and closed positions. Frame 16 is constructed so that it is airtight. When baffle plate 30 is in its closed position, it effects a positive shutdown of air through engine air passage 12.

Baffle arms 38(*a,b*) form connections with baffle plate blade 34 and operating shaft 58. Baffle arms 38(*a,b*) provide means for slidably moving baffle plate 30 within at least a portion of frame 16. Baffle arms 38(*a,b*) are rotatable and retractable. Each baffle arm 38 is affixed at its first end 37(*a*) to baffle plate 30 and at its second end 37(*b*) to operating shaft 58. When baffle arms 38 are in their first or retracted position, air flows through air intake passages 12,26. When baffle arms 38 are in their second or extended position, baffle plate 30 blocks air flow through air intake passages 12,26.

Each baffle arm 38 includes forearm 40 and upper arm 42 which are joined together to allow rotatable, retractable movement. Forearm 40 has at its first end 40(*a*) clevis 44 which receives baffle plate blade 34. Baffle plate blade 34 is secured in clevis 44 by pin 46. Second end 40(*b*) of forearm 40 is drilled and tapped to receive threaded connection of Morse rod end 48. The overall length of forearm 40 may be adjusted at the threaded connection between Morse rod end 48 and the second end 40(*b*) of forearm 40. Morse rod end 48 is inserted between teflon spacers 52 which abut cheek plates 50(*a,b*). Clevis pin 54 is inserted through cheek plates 50(*a,b*), teflon spacers 52 and Morse rod end 48 in order to maintain the rotatable position of forearm 40 and upper arm 42. Cotter pin 56 is inserted through clevis pin 54 to maintain the position of clevis pin 54.

Upper arm 42 is secured to operating shaft 58 at a point above the attachment point of forearm 40 to baffle plate blade 34 for defining a means for exerting force downward on the end of baffle plate 30 to create an airtight seal between baffle plate 30 and frame 16 as baffle plate 30 moves to the closed position.

Operating shafts 58 extend between frame 16 and pneumatic actuator assembly 70. First end 58(*a*) of operating shaft 58 is inserted through stationary bar 23. In FIG. 4, it can be seen that stationary bar 23 forms a lip extending over side panel 20(*a*). Stationary bar 23 and bottom plate 18 providing operating shafts 58 with structural support and have bores 59 through which operating shafts 58 are inserted. Bores 59 are fitted with o-ring seals 60 countersunk around their circumference. Washers 62 abut against o-ring seals 60. Roll pins 64 are inserted above washers 62 which abut stationary bar 23 and below washers 62 which abut bottom plate 18. Washers 62 provide a means for retaining the position of o-ring seals 60 and providing a wear plate for roll pins 64. Washers 62 and o-ring seals 60 prevent air from entering the interior of the housing 11 through bores 59.

Pneumatic actuator assembly 70 (FIGS. 2 and 5) includes air cylinder 72 to which is affixed at its first end 72(*a*) trunion mounts 74 and which is supported by the cylinder operating arms 76(*c,d*). Operating shafts 58 at their second end 58(*b*) are inserted through bores 77 of cylinder operating arms 76. Cylinder operating arms 76 clamp to operating shaft 58 and are secured in place by means of roll pins 82 and bolt fastener 84. Roll pin 82 is inserted through cylinder operating arms 76 and operating shafts 78 to maintain the position of cylinder operating arms 76 and prevent cylinder operating arms 76 from twisting on operating shafts 58. First end 78(*a*) of cylinder rod 78 connects to cylinder 72. Second end 78(*b*) of cylinder rod 78 connects to cylinder rod eye 80 by means of pin 81 which in turn connects to cylinder operating arm 76(*a,b*).

Figure 6:
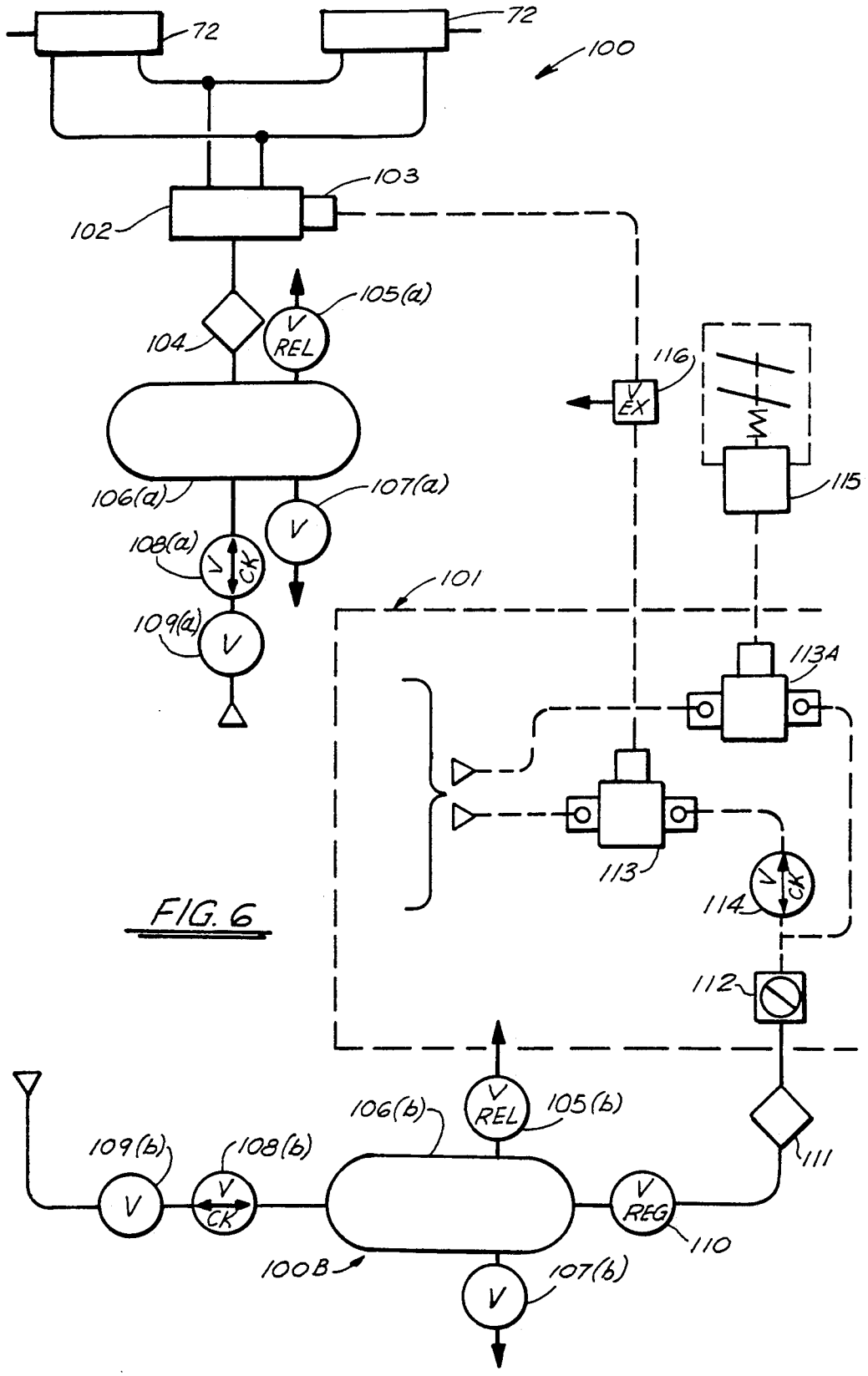
FIG. 6 is a schematic of the Remote Manual Control System.

FIG. 6 illustrates a schematic of control system 100 for engine air intake shutoff apparatus 10. Control system 100 consists of two basic pneumatic circuits, 100A and 100B. Circuit 100A provides power to retract or extend air cylinders 72. Circuit 100B controls when air cylinders 72 will extend or retract. Circuit 100A consist of air cylinders 72, 4-way valve 102, water trap filter 104, air reservoir 106(*a*), pressure relief valve 105(*a*), drain valve 107(*a*), check valve 108(*a*), and shutoff valve 109(*a*). Circuit 100B consists of air pilot actuator 103, quick exhaust valve 116, shuttle valves 113,113A, restrictor check valve 114, air selector switch 112, water trap filter 111, air regulator 110, air reservoir 106(*b*), pressure relief valve 105(*b*), drain valve 107(*b*), check valve 108(*b*), and shutoff valve 109(*b*).

Shutoff valves 109(*a,b*) are used to isolate pneumatic circuits 100(A,B) from the air supply of the mobile offshore drilling unit or vessel (not shown) allowing installation, testing and maintenance.

Check valves 108(*a,b*) in combination with reservoirs 106(*a,b*) provide an air supply for their respective pneumatic circuits that is non-decaying in the event the mobile offshore drilling unit or vessel loses its air supply.

Each air reservoir 106(*a,b*) is fitted with a pressure relief valve 105(*a,b*) which prevents over-pressuration of circuits 100(A,B). Likewise, each air reservoir 106(*a,b*) is fitted with drain valve 107(*a,b*), respectively, to allow condensed water (not shown) to be drained from air reservoir 106(*a,b*).

Water trap filters 104 and 111 function in their respective pneumatic circuits to provide conditioned air suitable for use downstream in their respective circuits.

Air regulator with gauge 110 provides the means for adjusting and holding constant the air pressure in circuit 100B downstream of air regulator with gauge 110, allowing time delays incorporated in circuit 100B to remain constant.

Remote control panel 101 includes air selector switch 112 having run and stop positions, shuttle valve 113 which can receive a pneumatic signal from the emergency shutdown system of mobile offshore drilling units or vessels and shuttle valve 113A which can send signals to engine governor control 115.

When air selector switch 112 is manually transferred from the run position to the stop position, air passes through it to restrictor check valve 114 and through shuttle valve 113A to engine governor control 115. Restrictor check valve 114 creates a time delay by retarding the flow of air to air pilot actuator 103 as the air passes through shuttle valve 113 and quick exhaust valve 116 allowing engine governor control 115 to initiate fuel shutdown, approximately three (3) seconds before the engine air intake shutoff apparatus is activated.

When air pressure at air pilot actuator 103 becomes sufficient to activate 4-way spring return valve 102, air pressure is directed from air reservoir 106(*a*), which can be mounted for example in the engine room of the mobile offshore drilling unit or vessel, to air cylinder 72 to close baffle plate 30. Thus, engine air intake passage 12 is closed and no air enters engine blower 13 so the engine shuts down.

As can be seen, valve 113A acts as a signal means for shutting off fuel flow into the engine. Valve 113 acts as a signal means for signaling the movement of baffle plate 34 between the first and second positions by controlling air cylinder 72.

When air selector switch 112 is manually transferred from the stop position to the run position, air may be bled through exhaust in air selector switch 112. When there is a drop in air pressure in the air line to the air pilot 103, the quick exhaust valve 116 opens to allow the escape of remaining air pressure so that air pilot actuator 103 returns to a normal position. When air pilot actuator 103 is in the normal position, 4-way spring return valve 102 returns to a normal position allowing air from air reservoir 106 to be directed to air cylinder 72 so that baffle plate 30 returns to its open position and no longer obstructs engine air intake passage 12. Once engine air intake passage 12 is open, air can enter engine blower 13 and the engine can be restarted and operated again.

In view of the numerous modifications which could be made to the preferred embodiment disclosed herein without departing from the scope or spirit of the present invention, the details herein are to be interpreted as illustrative and not in a limiting sense.

What is claimed as the invention is:

1. Apparatus including an engine air intake shutoff device and an engine air intake structure having an air intake passage, the device comprising:

(a) a frame mounted on the air intake structure for supporting movement of a baffle plate;

(b) a baffle plate moveable over the air intake passage within at least a portion of the frame;

(c) means for slidably moving the baffle plate within at least a portion of the frame between a first position allowing air flow through the air intake passage and a second position blocking air flow through the air intake passage, in response to a signal;

(d) means associated with the frame for sealing the baffle plate within the frame when the baffle plate is in the second position, wherein the means for slidably moving the baffle plate further includes a pair of retractable baffle arms, each of the baffle arms affixed at its first end to the baffle plate and at its second end to an operating shaft.

2. The apparatus of claim 1, further including an air filter adjacent the air intake passage.

3. The apparatus of claim 1, wherein the height of the frame is less than six inches.

4. The apparatus of claim 1, wherein the frame mounted over the air intake passage includes a lower surface upon which the baffle plate seals when it has moved from the first to the second position.

5. The apparatus of claim 4, wherein the baffle plate further has rollers extending above the surface of the baffle plate for engaging the frame to control the side to side motion of the plate as it extends or retracts.

6. The apparatus of claim 1, wherein the movement of the baffle plate is perpendicular to the flow of air through the air intake passage.

7. The apparatus of claim 1, wherein the second end of each of the arms is secured to the operating shaft at a point above the attachment point of the first end of the baffle arms to the baffle plate for defining a means for exerting force downward on the end of the baffle plate to create an airtight seal between the baffle plate and the frame as the baffle plate moves to the closed position.

8. The apparatus of claim 7, wherein each of the operating shafts undergo rotational movement in moving the retractable baffle arms.

9. The apparatus of claim 1, further including power means for powering the movement of the arms.

10. The apparatus of claim 9, wherein the power means further includes a pneumatic actuator assembly.

11. The apparatus of claim 1, wherein the frame mounted on the air intake structure for supporting the movement of the baffle plate is airtight.

12. The apparatus of claim 1, further including signal means for shutting off fuel flow into the engine at a point prior to or simultaneous with the signal for moving the baffle plate.

13. Apparatus including, in combination, an engine air-intake passage and a device for shutting off the air flow into an engine, the device comprising:

(a) a frame;

(b) a baffle plate supported in the frame, the baffle plate moveable over an air intake passage in response to a signal;

(c) a pair of retractable baffle arms attached to one end of the baffle plate for slidably moving the baffle plate between a first position allowing air flow through the air intake passage to a second position blocking air flow through the air intake passage;

(d) means associated with the frame for sealing the air intake passage when the baffle plate is in the second closed position.

14. The apparatus of claim 13, further including means for exerting a force downward on the baffle plate for creating an airtight seal as the baffle plate moves to the closed position, said means including baffle arms each secured at its second end at a point above the attachment point of its first end.

15. Apparatus including, in combination, an air intake shutoff device for diesel engines and air intake passage for providing air flow into the diesel engine, the device comprising:

(a) a frame;

(b) a baffle plate moveable within the frame over the air intake passage;

(c) a pair of retractable baffle arms secured to one end of the baffle plate for slidably moving the baffle plate between a first position allowing air flow through the air intake passage, when the baffle arms are in a retracted position, and a second position blocking air flow through the air intake passage, when the baffle arms are in an extended position;

(d) signal means for signalling the movement of the baffle plate between the first and second positions;

(e) means for exerting a force downward on the baffle plate for creating an airtight seal as the baffle plate moves to the closed position, said means including each of the baffle arms secured at its second end at a point above the attachment point of its first end;

(f) power means for powering the movement of the baffle arms between their retracted and extended positions.

16. The apparatus of claim 15, further including an air filter mounted on the air intake structure for filtering the air flow into the air intake passages.

* * * * *